US007780462B2

(12) United States Patent
Consoli et al.

(10) Patent No.: US 7,780,462 B2
(45) Date of Patent: Aug. 24, 2010

(54) ELECTROSTATIC DISCHARGE CONTACT

(75) Inventors: John Joseph Consoli, Harrisburg, PA (US); Robert Neil Mulfinger, York Haven, PA (US); Richard Elof Hamner, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 125 days.

(21) Appl. No.: 12/253,899

(22) Filed: Oct. 17, 2008

(65) Prior Publication Data

US 2010/0099282 A1 Apr. 22, 2010

(51) Int. Cl.
*H01R 4/66* (2006.01)

(52) U.S. Cl. ..... 439/108; 439/95; 439/607.1

(58) Field of Classification Search ..... 439/95, 439/108, 607.08, 607.09, 607.1, 607.11, 439/607.12, 607.13
See application file for complete search history.

(56) References Cited

U.S. PATENT DOCUMENTS 4,914,062 A * 4/1990 Voltz ..... 439/607.11
5,057,038 A * 10/1991 Bowen et al. ..... 439/497
5,085,596 A * 2/1992 Bowen et al. ..... 439/497
5,135,405 A * 8/1992 Fusselman et al. ..... 439/108
5,607,326 A * 3/1997 McNamara et al. .... 439/607.11
5,672,064 A * 9/1997 Provencher et al. ..... 439/79
5,885,103 A * 3/1999 Ernolf et al. ..... 439/579
6,083,048 A * 7/2000 Yamaguchi ..... 439/607.05
7,384,306 B2 6/2008 Malstrom et al.
7,497,736 B2 * 3/2009 Minich et al. ..... 439/607.05
2008/0014798 A1 * 1/2008 Pan ..... 439/607
2008/0045083 A1 * 2/2008 Metral et al. ..... 439/607
2010/0022112 A1 * 1/2010 Duesterhoeft et al. ..... 439/249

* cited by examiner

*Primary Examiner*—James Harvey

(57) ABSTRACT

An electrical connector assembly includes a dielectric housing having an interface being configured to receive a mating end portion of a mating connector. A plurality of receptacles is held by the housing. Each of the receptacles includes a ground shield and a center contact. Each center contact is configured to engage a corresponding electrical contact of the mating connector. An electrically conductive shell surrounds at least a portion of the housing. An electrostatic discharge (ESD) contact is held by the housing. The ESD contact includes a shell contact member and a plurality of ground contact members. The shell contact member is electrically connected to the shell. Each ground contact member is electrically connected to a corresponding one of the ground shields of the receptacles.

20 Claims, 12 Drawing Sheets

ELECTROSTATIC DISCHARGE CONTACT

BACKGROUND OF THE INVENTION

The subject matter described and/or illustrated herein relates generally to electrical connectors, and more particularly, to electrical connectors having multiple receptacles that each includes a center contact and a ground shield.

Some electrical systems and devices today are designed to include electrical connectors having multiple receptacles along a panel of an electrical system and/or device, such as a portable computer. For example, QSL RF connector systems may have multiple receptacles that each includes a center contact and a ground shield that surrounds at least a portion of the center contact. The receptacles allow an operator of the system to establish an electrical connection between the electrical connector and a peripheral device (for example, an RF antenna). The peripheral device and electrical connector may be electrically connected by mating a cable of the peripheral device with the receptacles in the electrical connector. Specifically, electrical contacts in a mating connector of the cable engage the center contact in each of the receptacles of the electrical connector to electrically connect the peripheral device to the electrical connector.

When the electrical connector and the mating connector of the cable are being mated, opposite charges at the connector interface may result in an electrostatic discharge (ESD) between the connectors. In some circumstances, ESDs can be generated simply by a person approaching or touching the connector interface or touching the center contacts or ground shields. Generally, very little current is associated with an ESD; however, the voltage can be high enough to damage or destroy certain types of electrical devices, such as semiconductor devices. For example, when the center contacts of the electrical connector are electrically connected to a circuit board, an ESD may damage or destroy electrical devices on the circuit board.

There is a need for providing ESD protection to an electrical connector having multiple receptacles that each includes a center contact and a ground shield.

BRIEF DESCRIPTION OF THE INVENTION

In one embodiment, an electrical connector assembly includes a dielectric housing having an interface being configured to receive a mating end portion of a mating connector. A plurality of receptacles is held by the housing. Each of the receptacles includes a ground shield and a center contact. Each center contact is configured to engage a corresponding electrical contact of the mating connector. An electrically conductive shell surrounds at least a portion of the housing. An electrostatic discharge (ESD) contact is held by the housing. The ESD contact includes a shell contact member and a plurality of ground contact members. The shell contact member is electrically connected to the shell. Each ground contact member is electrically connected to a corresponding one of the ground shields of the receptacles.

In another embodiment, an electrical connector assembly is configured to be mounted to a panel. The electrical connector assembly includes a dielectric housing having an interface being configured to receive a mating end portion of a mating connector. A plurality of receptacles is held by the housing. Each of the receptacles includes a ground shield and a center contact. Each center contact is configured to engage a corresponding electrical contact of the mating connector. An electrically conductive shell surrounds at least a portion of the housing. The electrically conductive shell is configured to engage the panel. An electrostatic discharge (ESD) contact is held by the housing. The ESD contact includes a shell contact member and a plurality of ground contact members. The shell contact member is electrically connected to the shell. Each ground contact member is electrically connected to a corresponding one of the ground shields of the receptacles.

DETAILED DESCRIPTION OF THE INVENTION

Figure 1:
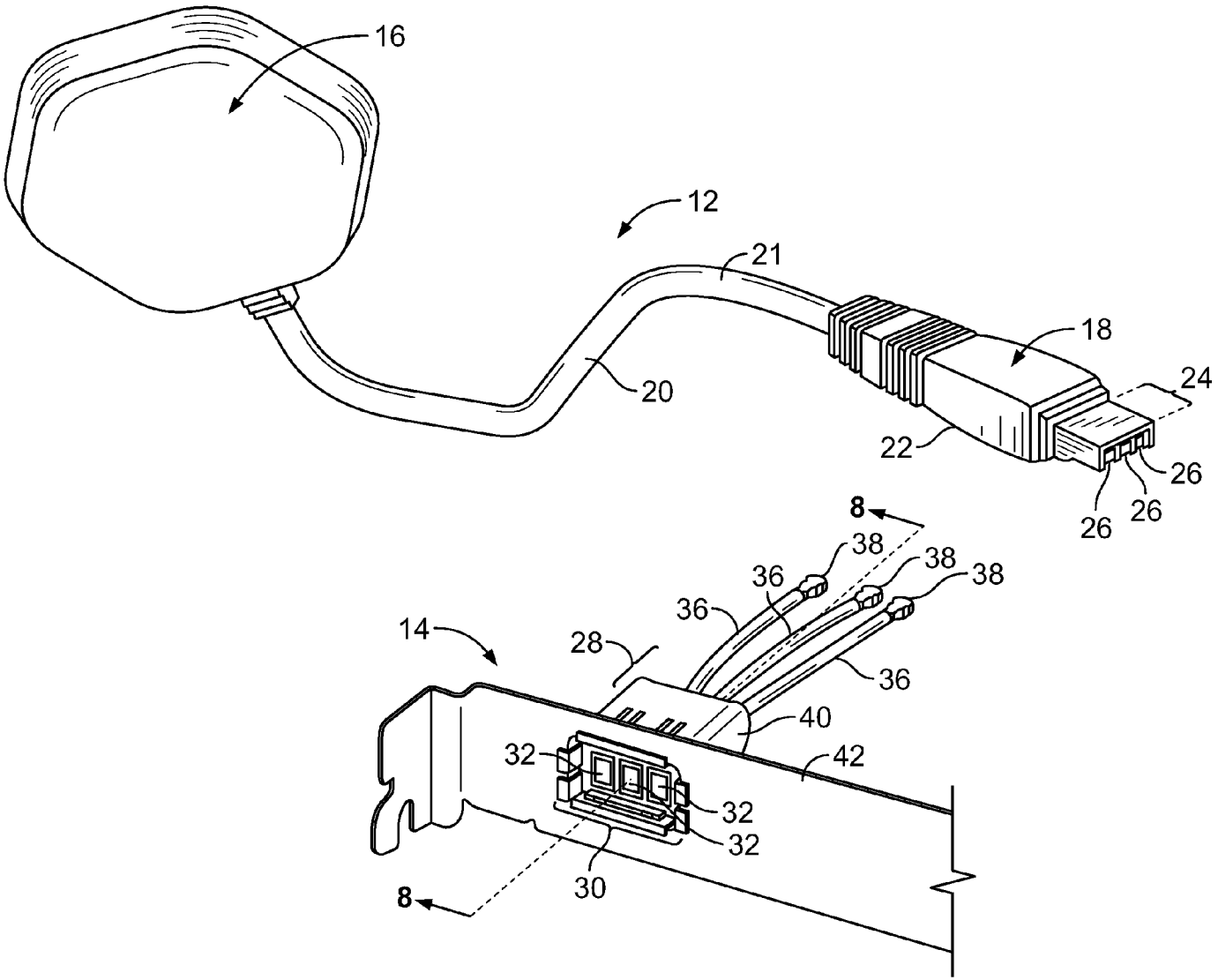
FIG. 1 is a perspective view of an exemplary device assembly and an exemplary embodiment of an electrical connector assembly.

FIG. 1 is a perspective view of an exemplary device assembly 12 and an exemplary embodiment of an electrical connector assembly 14. The electrical connector assembly 14 and the device assembly 12 mate with each other to enable electrical communication therebetween. The device assembly 12 includes a peripheral device 16 interconnected with a mating connector 18 of a device cable 20. In the exemplary embodiment, the device 16 is an RF antenna. In other embodiments, the device 16 may include any other electronic component capable of communicating with the electrical connector assembly 14, such as, but not limited to, a mobile antenna, a Global Positioning System ("GPS") device, a radio device, a handheld computing device (such as, but not limited to, a Personal Digital Assistant ("PDA")), a mobile phone, an automotive telematic device, a WiFi device, a WiMax device, a data device, and/or the like. In some embodiments, the device 16 is an antenna capable of communicating using three different frequency ranges, such as, but not limited to, a triple dipole 802.11 a/b/g/n antenna and/or the like.

The cable 20 is capable of communicating data between the device 16 and the mating connector 18. For example, the cable 20 may include a center conductive wire (not shown)

enclosed by an insulator 21. In some embodiments, the cable 20 includes at least three wires.

The mating connector 18 includes a housing 22 having a mating end portion 24. The mating end portion 24 is shaped to be inserted into the electrical connector assembly 14. A plurality of electrical contacts 26 are provided along the mating end portion 24. Each of the electrical contacts 26 may be a signal contact, a ground contact, or a power contact. In some embodiments, one or more of the electrical contacts 26 includes a plurality of contacts. For example, each of the electrical contacts 26 may include a signal contact and a ground contact. While three electrical contacts 26 are shown in the exemplary embodiment, any number of electrical contacts 26 may be used. The wires in the cable 20 terminate to one or more of the electrical contacts 26. The mating end portion 24 is inserted into the electrical connector assembly 14 to establish a conductive path between the device 16 and the electrical connector assembly 14. For example, the mating end portion 24 is inserted into the electrical connector assembly 14 to close a circuit that includes the device 16, the wires in the cable 20, the electrical contacts 26, and the electrical connector assembly 14.

The electrical connector assembly 14 includes a housing 28 having an interface 30. In the exemplary embodiment, the housing 28 is mounted to a chassis panel 42. In other embodiments, the housing 28 may be mounted to a circuit board (not shown). In the exemplary embodiment, the housing 28 is configured to receive the mating end portion 24 of the device assembly 12 through the interface 30. A plurality of receptacles 32 is aligned along the interface 30 to receive the electrical contacts 26 of the mating end portion 24 of the mating connector 18. For example, each of the receptacles 32 may receive one or more of the electrical contacts 26 when the mating end portion 24 is inserted into the housing 28. While three receptacles 32 are shown in the exemplary embodiment, the electrical connector assembly 14 may include any number of receptacles 32.

Alternatively, the mating end portion 24 of the mating connector 18 may be configured to receive the electrical connector assembly 14. For example, the receptacles 32 may be inserted into the mating end portion 24 to establish an electrical connection between the device 16 and the electrical connector assembly 14.

A center contact 34 (FIG. 3) is held in each of the receptacles 32. In the exemplary embodiment, each center contact 34 is a signal contact. However, in other embodiments, one or more of the center contacts 34 may be a ground contact or a power contact. The center contact 34 in each receptacle 32 engages a corresponding electrical contact 26 of the mating connector 18 to establish an electric connection between the device assembly 12 and the electrical connector assembly 14 when the mating end portion 24 is inserted into the housing 28. Each of the center contacts 34 is connected to one of a plurality of cables 36. For example, a conductive wire (not shown) in each of the cables 36 may be terminated to the corresponding center contact 34. Each of the cables 36 includes a mating end portion 38. In some embodiments, the mating end portions 38 mate with electrical contacts (not shown) on a circuit board (not shown). For example, the mating end portions 38 may be placed over a conductive post extending from a circuit board. In another example, the mating end portions 38 may be inserted into an opening in the circuit board. The mating end portions 38 may be electrically connected to one or more conductive traces (not shown) in the circuit board in order to establish an electrical connection with the circuit board.

In the exemplary embodiment, the housing 28 is at least partially enclosed within an electrically conductive shell 40. The shell 40 may shield the electrical connector assembly 14 from electromagnetic interference.

Figure 2:
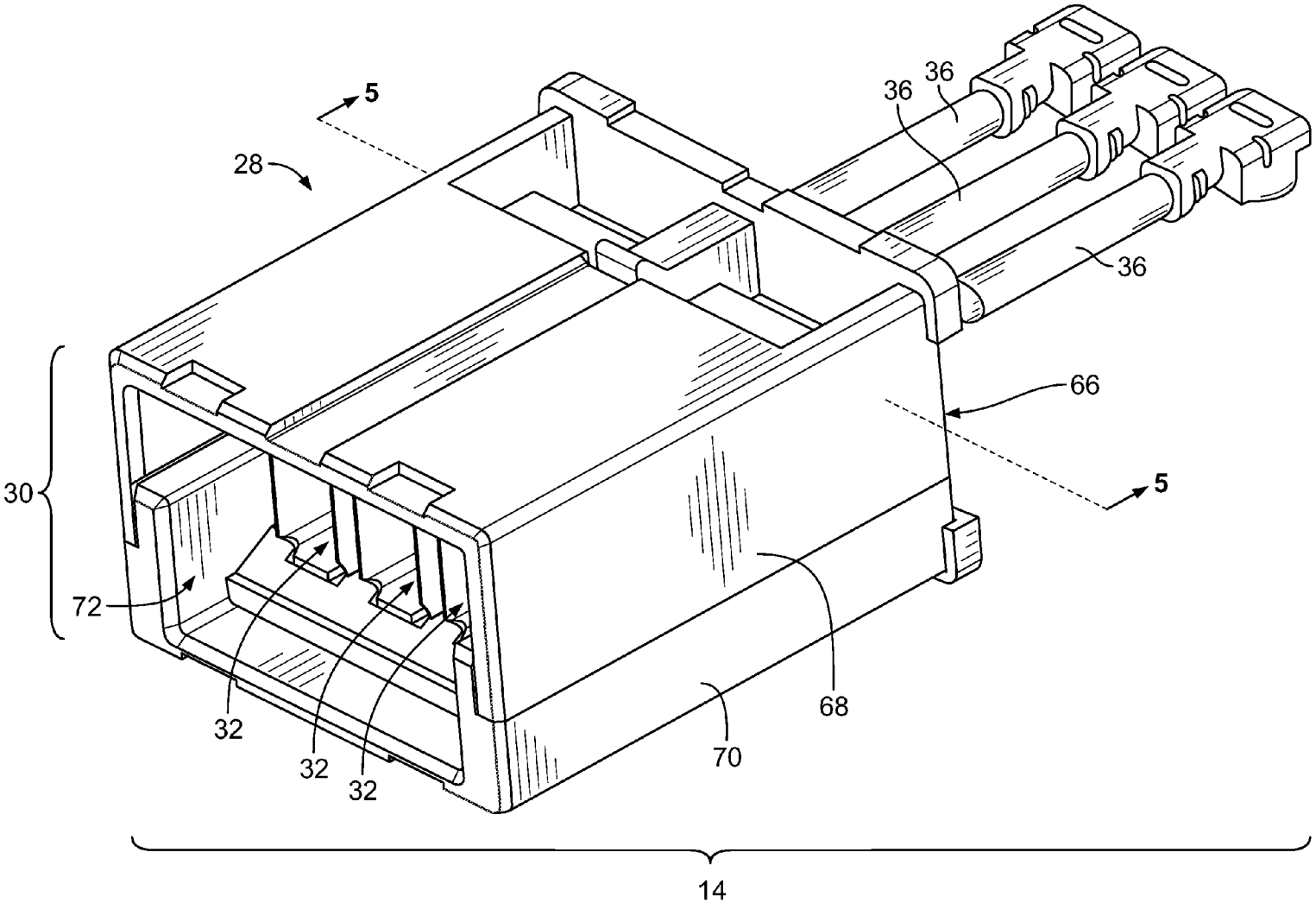
FIG. 2 is a perspective view of the electrical connector assembly shown in FIG. 1 with a shell removed therefrom.

FIG. 2 is a perspective view of the electrical connector assembly 14 with the shell 40 removed therefrom. As shown in FIG. 2, the housing 28 extends between the interface 30 and a cable end portion 66. An interior chamber 72 of the housing 28 is located between the interface 30 and the cable end portion 66. In some embodiments, the housing 28 may include a top portion 68 and a bottom portion 70. The top and bottom portions 68 and 70 have complementary shapes so that the top and bottom portions 68 and 70 mate with one another to form the housing 28, and to at least partially enclose the receptacles 32. In other embodiments, the housing 28 is integrally formed as a single unitary body.

Figure 3:
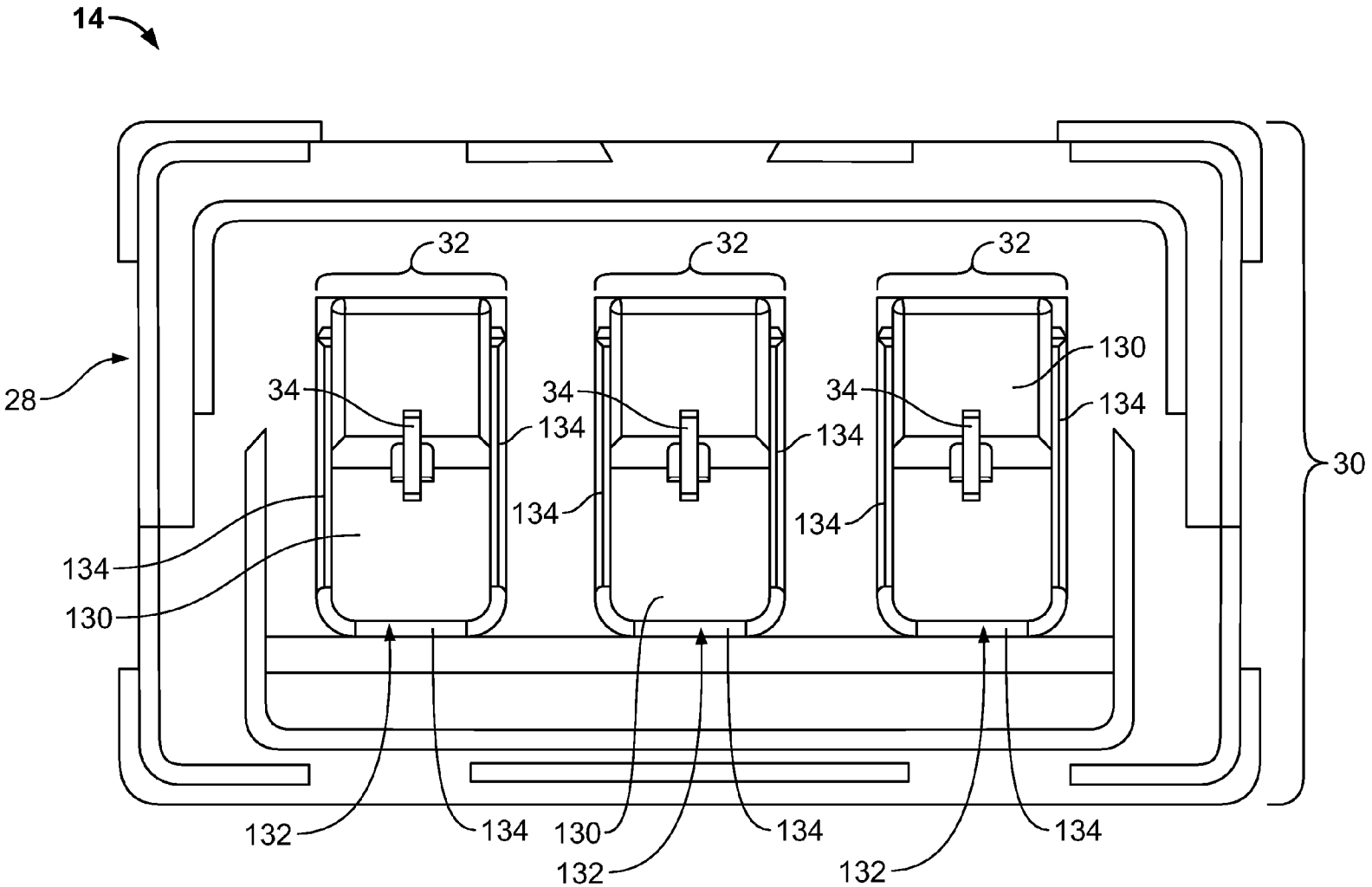
FIG. 3 is an elevational view of an interface of the electrical connector assembly shown in FIG. 1 with the shell removed therefrom.
Figure 8:
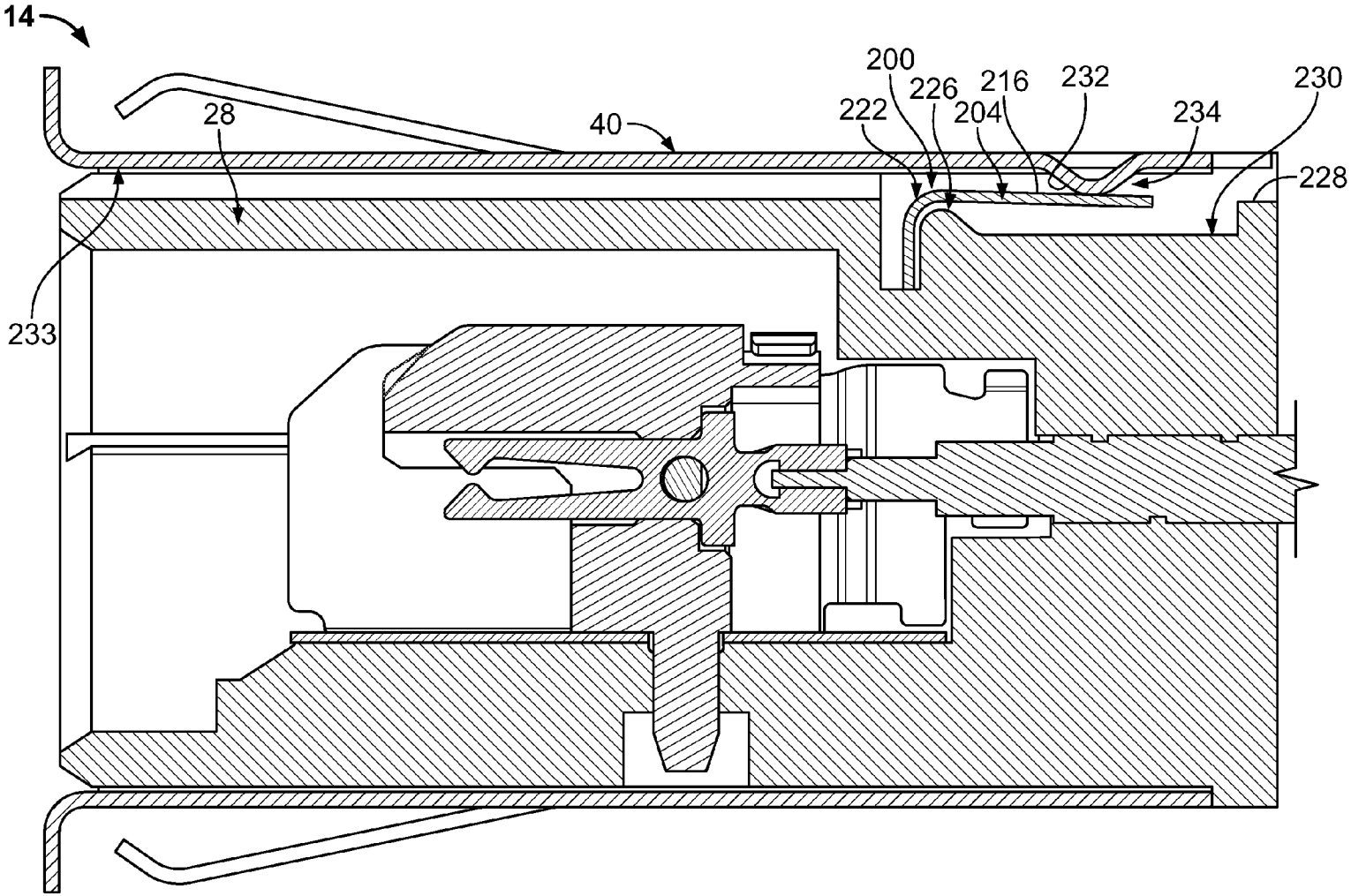
FIG. 8 is a cross-sectional view of the electrical connector assembly shown in FIGS. 1-3 taken along line 8-8 of FIG. 1.
Figure 10:
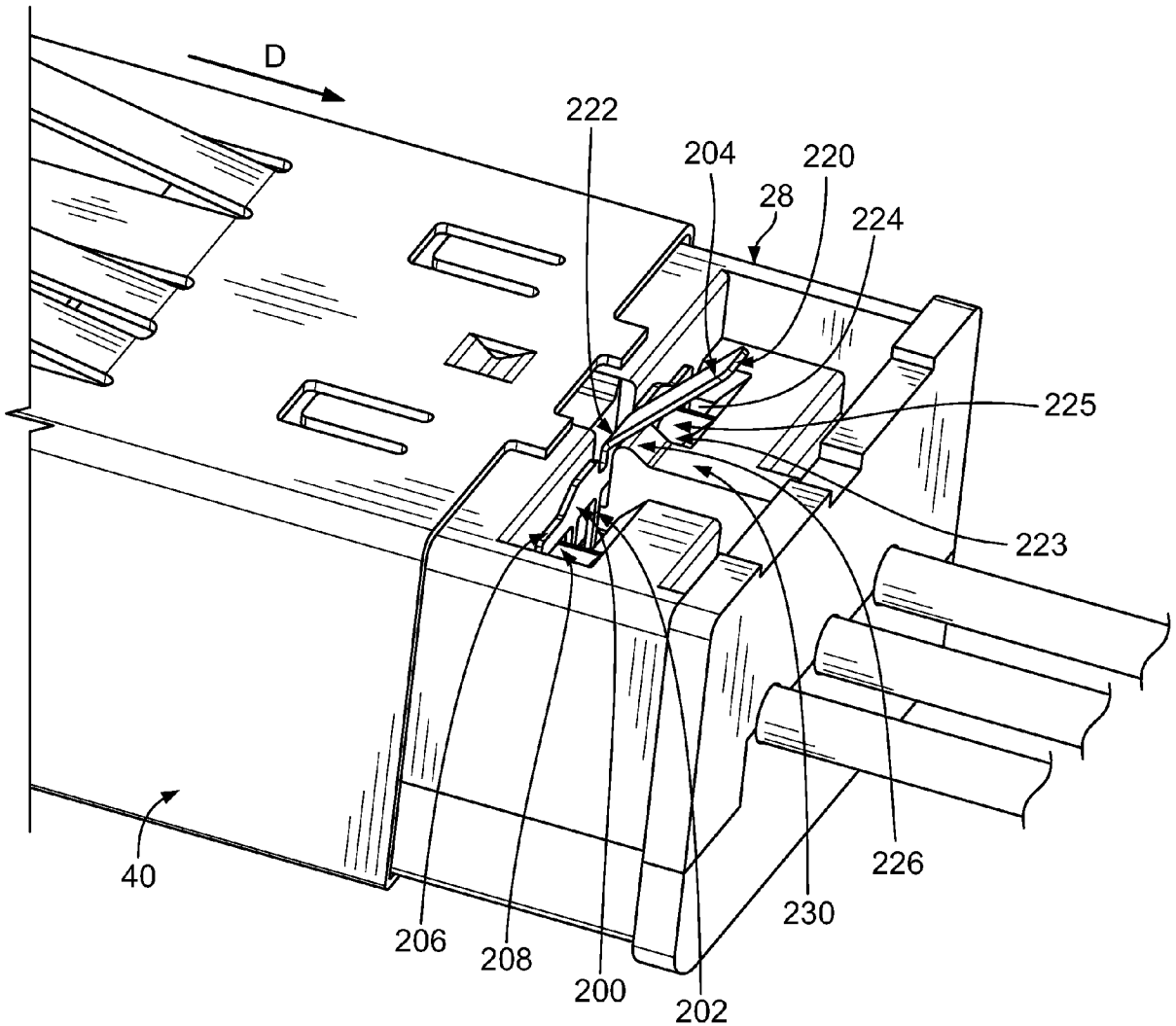

FIG. 3 is an elevational view of the interface 30 of the electrical connector assembly 14 with the shell 40 removed therefrom. As shown in FIG. 3, each of the receptacles 32 is held by the housing 28. In the exemplary embodiment, each of the receptacles 32 includes a dielectric body 130, a ground shield 132, and one of the center contacts 34. Each of the dielectric bodies 130 may include, and/or be formed from, a dielectric material. Each of the dielectric bodies 130 holds one of the center contacts 34. In some embodiments, the dielectric bodies 130 electrically isolate the center contacts 34 from the housing 28 and the shell 40 (FIGS. 1, 8, and 10).

Figure 4:
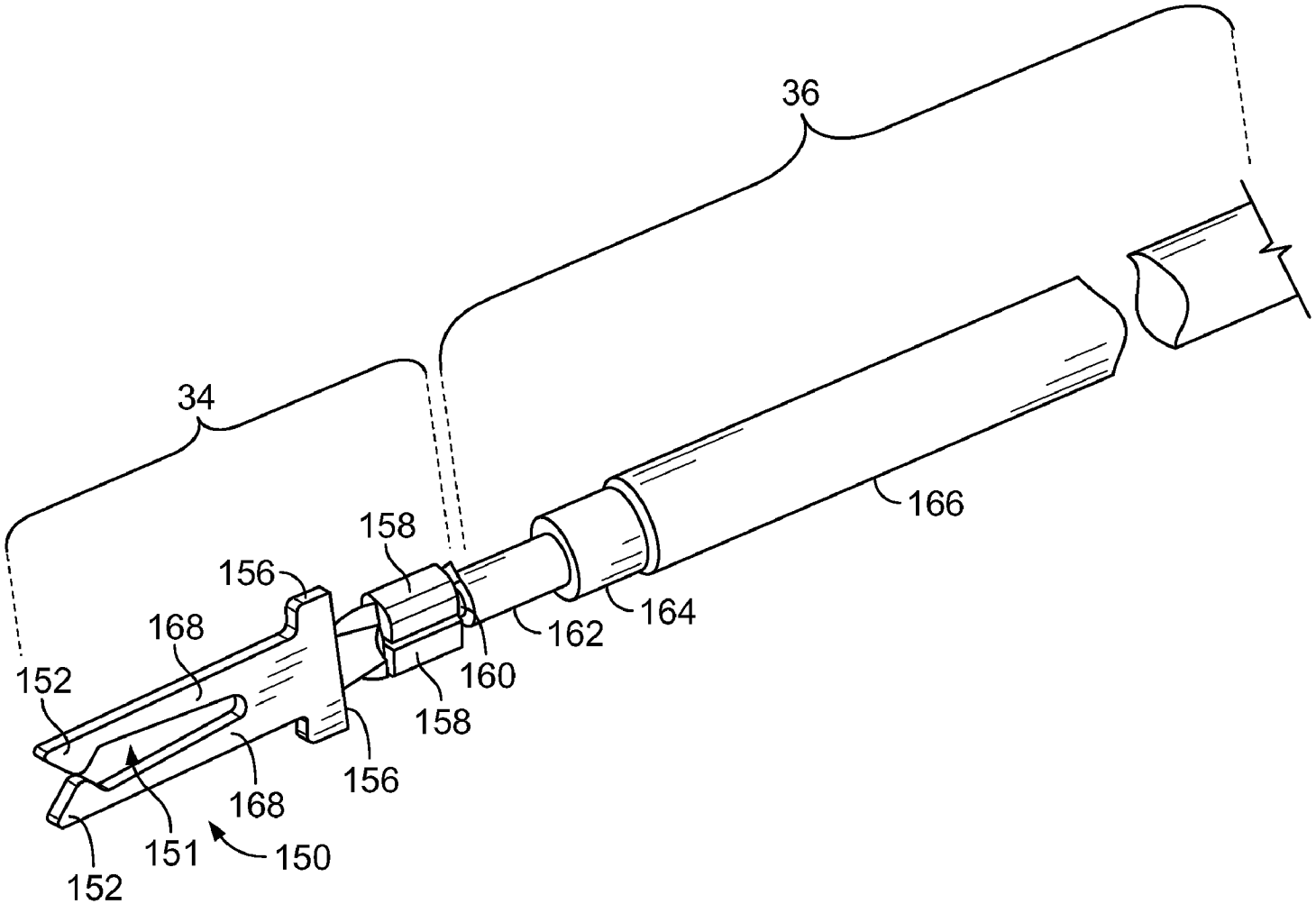
FIG. 4 is a perspective view of an exemplary embodiment of a center contact and an exemplary embodiment of a corresponding cable of the electrical connector assembly shown in FIGS. 1-3.

The ground shields 132 may protect the center contacts 34 from electromagnetic interference. In some embodiments, one or more of the ground shields 132 is electrically connected to an electrical ground of the corresponding cable 36 (FIGS. 1, 2, and 4). Moreover, in some embodiments, one or more of the electrical contacts 26 of the mating connector 18 may engage a corresponding one of the ground shields 132 to form an electrical ground connection therebetween.

In the exemplary embodiment, each of the ground shields 132 includes three ground shield portions 134 that each surrounds a portion of the corresponding center contact 34 and a portion of the corresponding dielectric body 130. However, each ground shield 132 may include any number of ground shield portions 134 that each surrounds any portion(s) and amount of the circumference of the corresponding center contact 34 and/or the corresponding dielectric body 130, including, but not limited to, embodiments wherein the ground shield 132 surrounds an approximate entirety of the circumference of the corresponding center contact 34 and the corresponding dielectric body 130. In the exemplary embodiment, for each ground shield 132, the ground shield portions 134 are not mechanically connected together such that they are separate from each other. Alternatively, for one or more of the ground shields 132, one or more of the corresponding ground shield portions 134 may be mechanically connected to one or more other corresponding ground shield portions 134.

FIG. 4 is a perspective view of an exemplary embodiment of one of the center contacts 34 and an exemplary embodiment of the corresponding cable 36. In the exemplary embodiment, the center contact 34 includes a fork contact end portion 150 that defines a receptacle 151 for receiving a corresponding one of the electrical contacts 26 (FIG. 1) of the mating connector 18 (FIG. 1). Specifically, the fork contact end portion 150 includes a plurality of beams 168 extending to a plurality of tip portions 152. The tip portions 152 engage the corresponding electrical contacts 26 to establish an electrical connection between the cable 20 (FIG. 1) and the center contact 34. For example, the tip portions 152 may be deflected away from each another, against their natural bias, when the corresponding electrical contact 26 is received by the center contact 34. The tip portions 152 may at least partially return to a natural undeflected position once the corresponding electrical contact 26 is fully inserted into the receptacle 151. The natural undeflected position is illustrated in FIG. 4. Although in the exemplary embodiment the center contacts 34 include the receptacles 151 and therefore are receptacle contacts, alternatively one or more of the center contacts 34 includes any other structure, means, and/or the like, such as, but not limited to, an extension (not shown) that is received within a receptacle (not shown) of the corresponding electrical contact 26 of the mating connector 18.

In the exemplary embodiment, the center contact 34 includes one or more fins 156 and one or more contact tabs 158. The fins 156 may be used to align the center contact 34 in the corresponding dielectric body 130 (FIG. 3). For example, the fins 156 may align the center contact 34 when the center contact 34 is inserted into the corresponding dielectric body 130. The contact tabs 158 engage an electrically conductive core 160 of the cable 36 to provide an electrical connection between the center contact 34 and the cable 36. In some embodiments, the contact tabs 158 are crimped onto the electrically conductive core 160 to establish the electrical connection. Alternatively, the electrically conductive core 160 may be electrically connected to the center contact 34 in any other method, fashion, and/or the like and/or using any other structure, means, and/or the like, such as, but not limited to, being soldered to the center contact 34 in a location that is proximate to the fins 156 and/or the contact tabs 158, and/or the like.

The cable 36 is a coaxial cable in the exemplary embodiment. For example, the cable 36 may include the conductive core 160 surrounded by a dielectric spacer 162. The dielectric spacer 162 is surrounded by a conductive sheath 164. The conductive sheath 164 is enclosed within a dielectric jacket 166. The conductive core 160 may include one or more wires that carry data, ground, and/or power signals from the center contact 34 to the mating end portion 38 (FIG. 1) of the cable 36. The dielectric spacer 162 separates the conductive core 160 from the conductive sheath 164. In some embodiments, the dielectric spacer 162 electrically isolates the conductive core 160 from the conductive sheath 164. The conductive sheath 164 may shield the conductive core 160 from electromagnetic interference. For example, the conductive sheath 164 may be electrically connected to an electrical ground of the circuit board (not shown) to which the mating end portions 38 of the cables 36 are mounted. The dielectric jacket 166 encloses the conductive sheath 164. The dielectric jacket 166 may electrically isolate and protect the conductive sheath 164.

Figure 5:
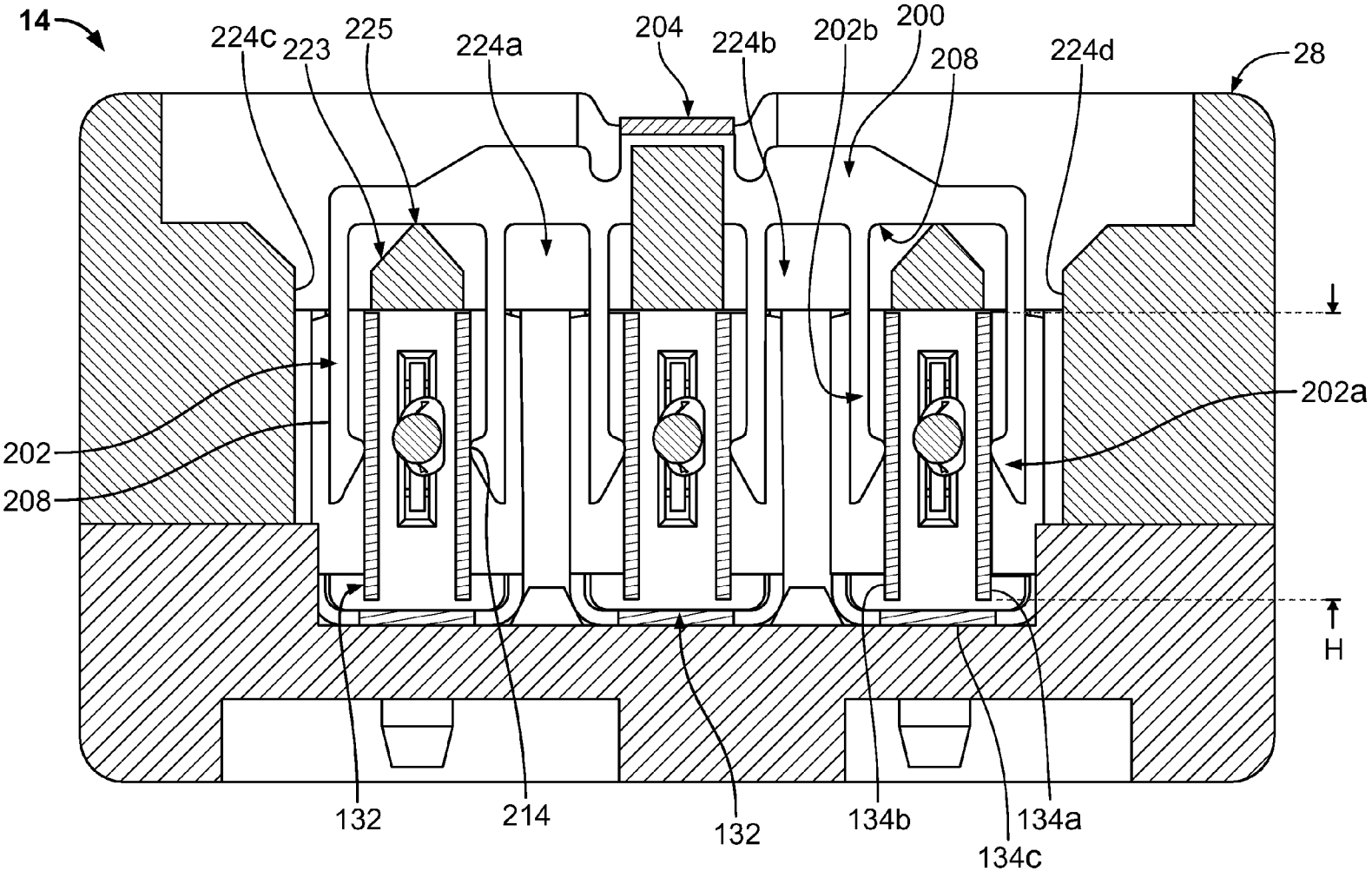
FIG. 5 is a cross-sectional view of the electrical connector assembly shown in FIGS. 1-3 with the shell removed therefrom and taken along line 5-5 of FIG. 2.

Referring now to FIG. 5, the electrical connector assembly 14 includes an electrostatic discharge (ESD) contact 200 held by the housing 28. As will be described below, the ESD contact 200 includes a plurality of ground contact members 202 that is each electrically connected to a corresponding one of the ground shields 132 of a corresponding one of the receptacles 32. The ESD contact 200 also includes a shell contact member 204 that is electrically connected to the shell 40 (FIGS. 1, 8, and 10). The ESD contact 200 thereby provides an electrical connection between each of the ground shields 132 and the shell 40 to facilitate providing ESD protection to the electrical connector assembly 14, as will be described below.

Figure 6:
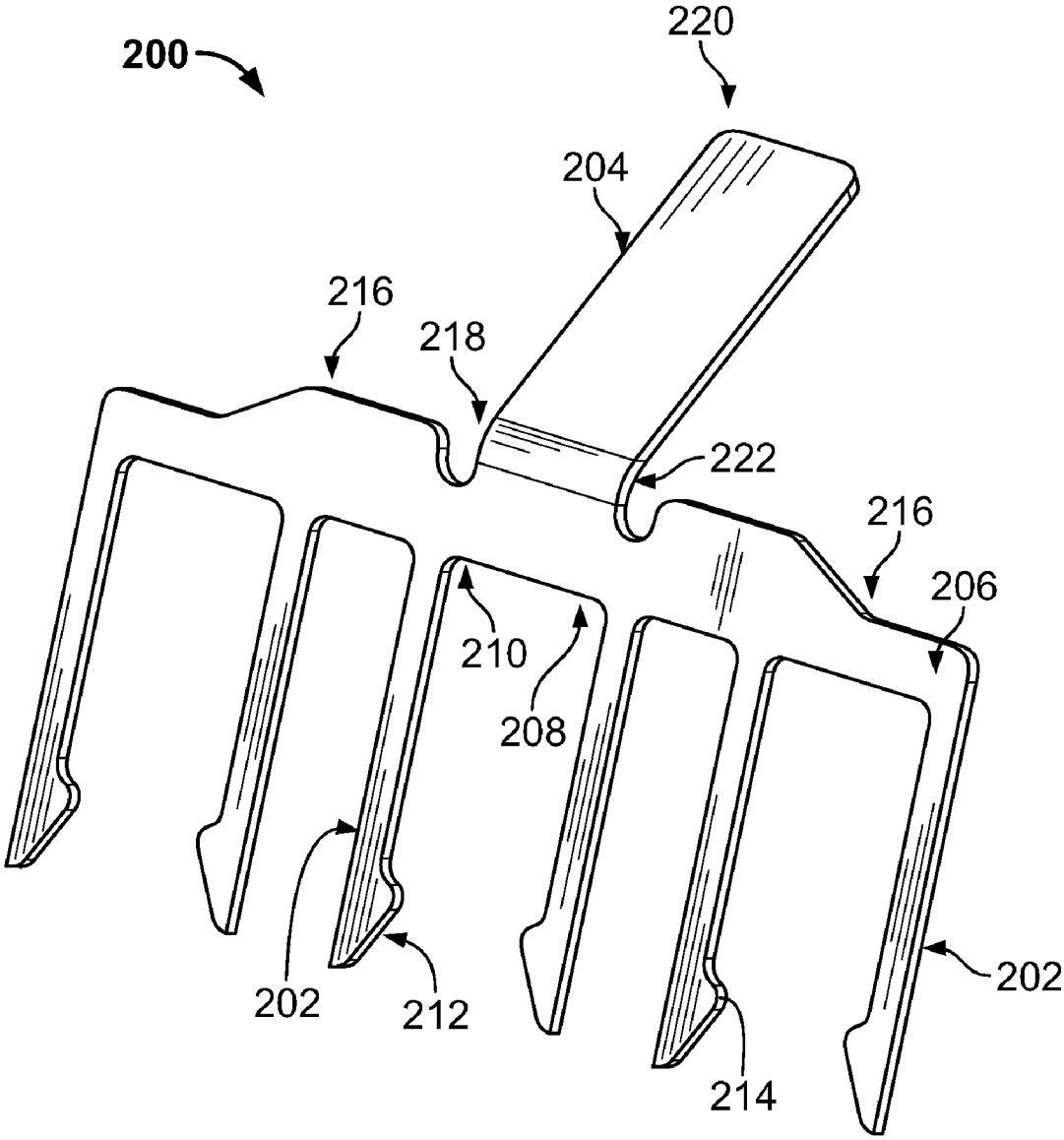
FIG. 6 is a perspective view of an exemplary embodiment of an electrostatic discharge (ESD) contact of the electrical connector assembly shown in FIGS. 1-3 and 5.

FIG. 6 is a perspective view of an exemplary embodiment of the ESD contact 200. The ESD contact 200 includes a base 206, the ground contact members 202, and the shell contact member 204. In the exemplary embodiment, each ground contact member 202 is an elongate leg that extends outwardly from a side portion 208 of the base 206. The base 206 is common to all of the ground contact members 202. Each ground contact member 202 extends outwardly from an end portion 210 that extends from the base 206 to a tip portion 212. In the exemplary embodiment, each of the tip portions 212 includes an extension 214 that engages the corresponding ground shield 132 (FIGS. 3 and 5). In alternative to the elongate legs of the ground contact members 202, the extensions 214, and/or any other structure of the ground contact members 202 described and/or illustrated herein, each ground contact member 202 may include any other suitable size, shape, structure, means, and/or the like that enable the ground contact members 202 to function as described and/or illustrated herein. Although six ground contact members 202 are shown herein, the ESD contact 200 may include any number of ground contact members 202 for engagement with any number of ground shields 132.

The shell contact member 204 extends outwardly from a side portion 216 of the base 206 that is opposite the side portion 208. In the exemplary embodiment, the shell contact member 204 is an elongate tab that extends outwardly from the base 206. The shell contact member 204 extends outwardly from an end portion 218 that extends from the base 206 to a free end portion 220. In the exemplary embodiment, the shell contact member 204 includes a bend portion 222 about which the shell contact member 204 is bent. As will be described below, the shell contact member 204 is bent about the bend portion 222 during assembly of the electrical connector assembly 14 (FIGS. 1-3, 5, and 8-10) via engagement with the shell 40 as the shell 40 is installed on the housing 28 (FIGS. 1-3, 5, and 7-10). In alternative to the elongate tab of the shell contact member 204, the bend portion 222, and/or any other structure of the shell contact member 204 described and/or illustrated herein, the shell contact member 204 may include any other suitable size, shape, structure, means, and/or the like that enable the shell contact member 204 to function as described and/or illustrated herein. Although only one shell contact member 204 is shown herein, the ESD contact 200 may include any number of shell contact members 204 for engagement with the shell 40 (FIGS. 1, 8, and 10). In the exemplary embodiment, and as will be described below, at least a portion of the shell contact member 204 is optionally a spring.

Figure 7:
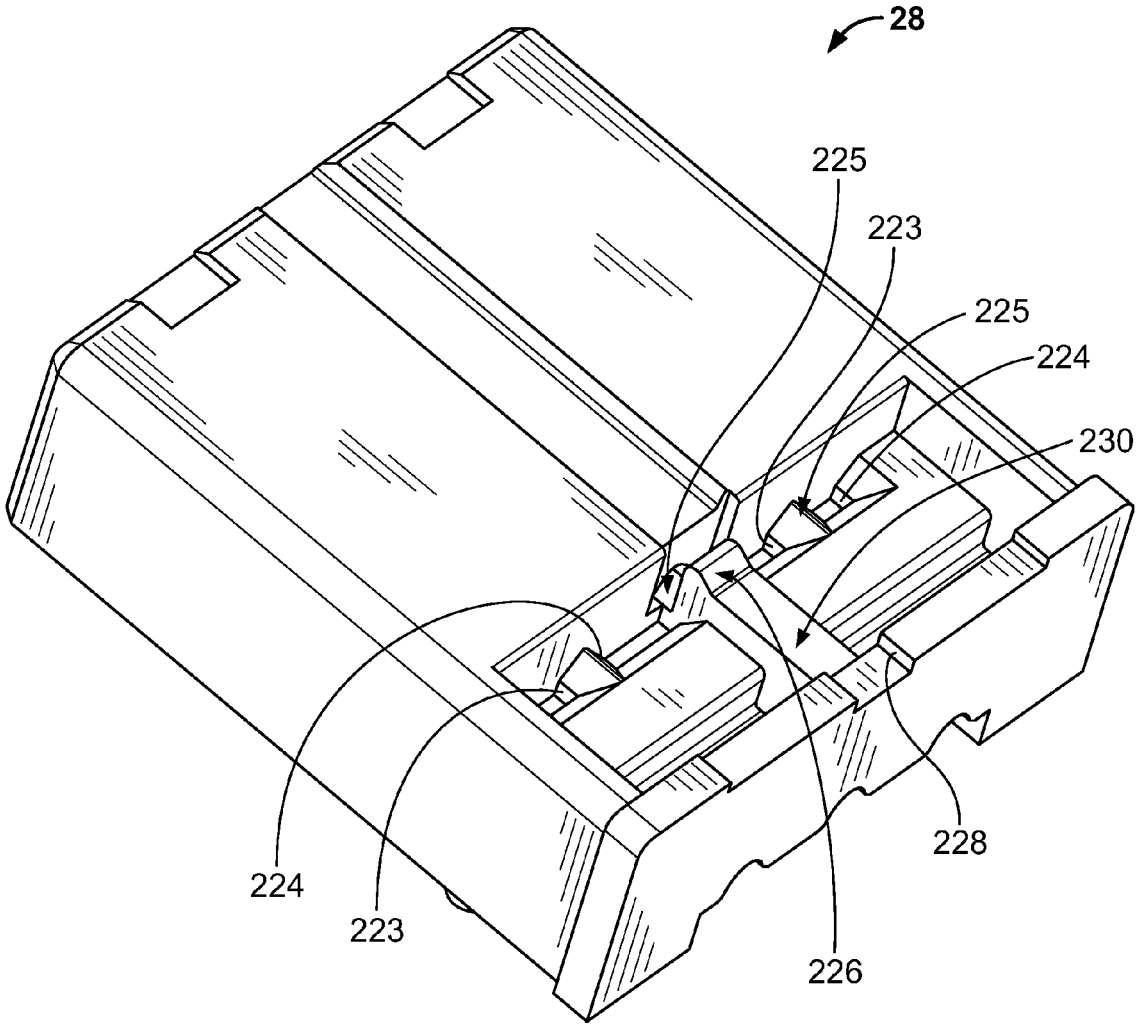
FIG. 7 is a perspective view of an exemplary embodiment of a housing of the electrical connector assembly shown in FIGS. 1-3 and 5.

FIG. 7 is a perspective view of an exemplary embodiment of the housing 28 of the electrical connector assembly 14 (FIGS. 1-3, 5, and 8-10). The housing 28 includes a plurality of slots 224 for receiving the ground contact members 202 (FIGS. 5, 6, 9, and 10) therein. A plurality of divider walls 223 of the housing 28 separate the slots 224. Each divider wall 223 includes an end portion 225 that engages the side portion 208 of the ESD contact base 206. The housing 28 also includes an anvil 226, a slot 228, and a shelf 230. As will be described below, the bend portion 222 (FIGS. 6, 9, and 10) of the shell contact member 204 is bent around the anvil 226 during installation of the shell 40 (FIGS. 1, 8, and 10) on the housing 28. The slot 228 exposes at least a portion of an interface 234 (FIG. 8) between the shell contact member 204 (FIGS. 5, 6, and 8-10) and the shell 40 after the shell 40 has been installed on the housing 28. The shelf 230 limits an amount that the shell contact member 204 is bent about the bend portion 222. Although four slots 224 are shown, the housing 28 may include any number of slots 224 for each receiving any number of the ground contact members 202 therein.

Referring now to FIG. 5, when assembled, the ESD contact 200 is held by the housing 28 such that the elongate leg of each of the ground contact members 202 is held within a corresponding one of the slots 224. The side portion 208 of the base 206 engages the end portions 225 of the divider walls 223. As can be seen in FIG. 5, two of the slots 224*a* and *b* each receives two ground contact members 202 therein, while another two of the slots 224*c* and *d* each receives only one ground contact member 202 therein. However, as described above, each slot 224 may receive any number of the ground contact members 202 therein and the housing 28 may include any number of slots 224 overall, whether or not the number of slots 224 is the same as the number of ground contact members 202.

The extensions 214 of each of the ground contact members 202 engages a corresponding one of the ground shields 132 to electrically connect the ESD contact 200 to the ground shields 132. In the exemplary embodiment, each ground shield 132 is engaged by, and therefore electrically connected to, two ground contact members 202. Specifically, two of the ground shield portions 134*a* and *b* of each of the ground shields 132 are engaged by a corresponding ground contact member 202*a* and *b*, respectively. However, as described above, each ground shield 132 may be engaged by any number of ground contact members 202 and the ESD contact 200 may include any number of ground contact members 202, whether not the number of ground contact members 202 is the same as the number of ground shields 132. Moreover, although each ground shield portion 134 is shown as being engaged by a single ground contact member 202, each ground shield portion 134 may be engaged by any number of ground contact members 202. Furthermore, although the ground contact members 202 are shown as engaging the ground shield portions 134*a* and *b*, as opposed to a ground shield portion 134*c*, each ground contact member 202 may engage any portion 134 of the corresponding ground shield 132. Each ground contact member 202 is shown in the exemplary embodiment as engaging the corresponding ground shield portion 134 at approximately a center of a height H of the corresponding ground shield portion 134. However, each ground contact member 202 may engage the corresponding ground shield portion 134 at any other location of the corresponding ground shield portion than is shown.

Referring now to FIG. 8, when assembled, the ESD contact 200 is held by the housing 28 such that the shell contact member 204 is engaged with, and thereby electrically connected to, the shell 40 at the interface 234. In the exemplary embodiment the shell 40 includes an optional extension 232 that extends outwardly from an interior surface 233 of the shell 40. When the shell 40 is installed on the housing 28, the extension 232 extends toward the shelf 230. The shell contact member 204 is engaged with the extension 232 of the shell 40 such that the shell contact member 204 is electrically connected to the shell 40. As can be seen in FIG. 8, when the shell is installed on the housing 28, the bend portion 222 of the shell contact member 204 is bent around the anvil 226. The slot 228 within the housing 28 exposes at least a portion of the interface 234 between the shell 40 and the shell contact member 204 such that the electrical connection between the shell 40 and the ESD contact 200 can be verified after the shell 40 is installed on the housing 28.

Referring again to FIG. 1, the panel 42 is optionally electrically conductive such that an electrical connection is formed between the shell 40 and the panel 42. The electrical connection between the ESD contact 200 and the shell 40 may provide an electrical path for ESD to be dispensed from the ground shields 132 (FIGS. 3 and 5) to the shell 40, and subsequently to the panel 42.

Figure 9:
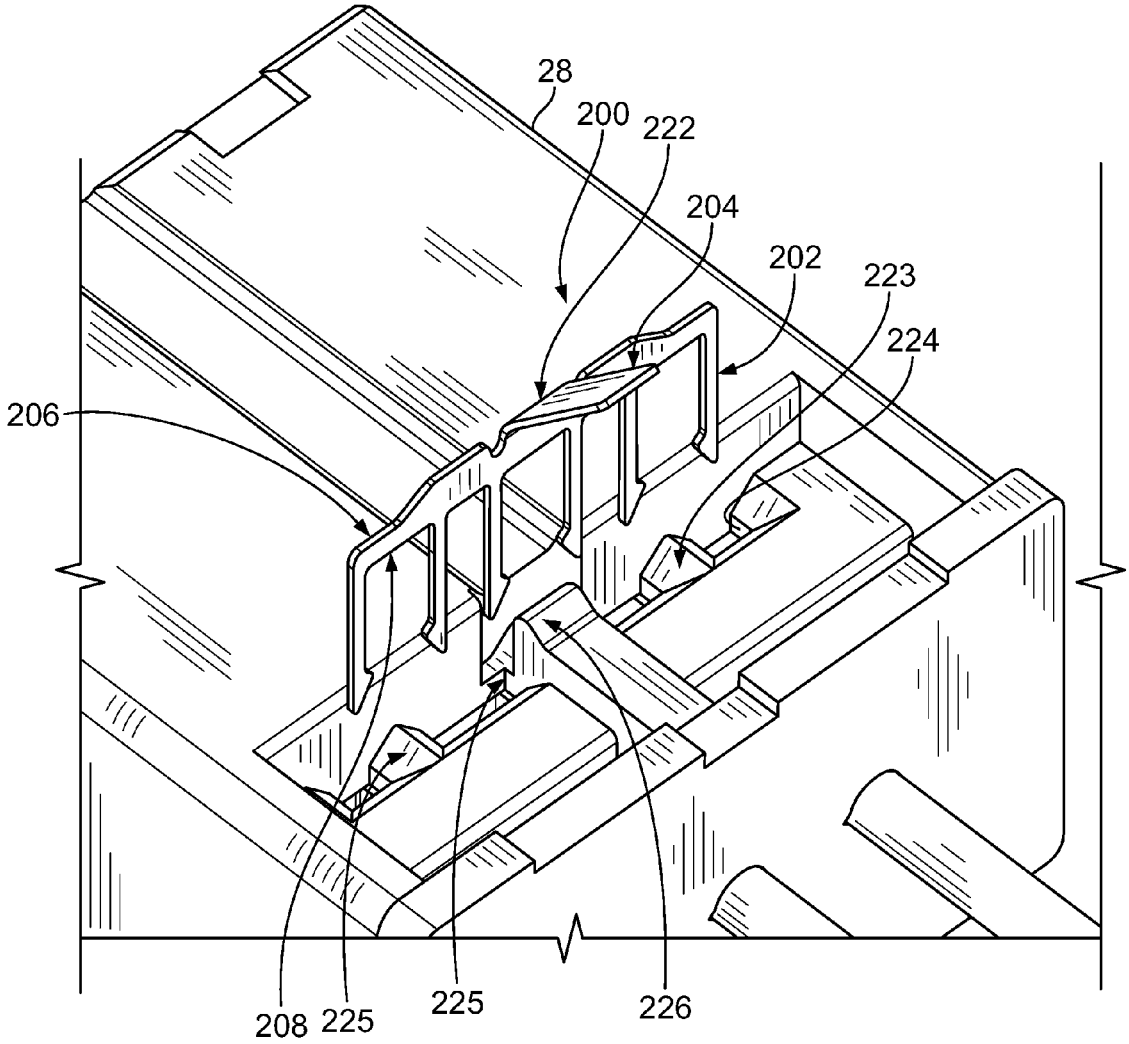
FIGS. 9 and 10 are perspective views illustrating assembly of a portion of the electrical connector assembly shown in FIGS. 1-3, 5, and 8.

Referring now to FIG. 9, to assemble the ESD contact 200 to the housing 28, the ESD contact 200 is positioned adjacent the housing 28 such that each of the ground contact members 202 is aligned with the corresponding slot 224 of the housing 28. The ESD contact 200 can then positioned within the housing 28 by inserting each of the ground contact members 202 within the corresponding slot 224. The ground contact members 202 are inserted within the slots 224 until the side portion 208 of the base 206 engages the end portions 225 of the divider walls 223 and the bend portion 222 of the shell contact member 204 engages the anvil 226.

FIG. 10 illustrates the ESD contact 200 received within the housing 28. Each ground contact member 202 is received within the corresponding slot 224 of the housing 28. The side portion 208 of the base 206 engages the end portions 225 of the divider walls 223 and the bend portion 222 of the shell contact member 204 engages the anvil 226. The shell 40 can then be installed on the housing 28 by inserting the shell 40 over the housing 28 in the direction D shown in FIG. 10. As the shell 40 is moved along the housing 28 in the direction D, the shell 40 engages the shell contact member 204 and bends the shell contact member 204 about the bend portion 222 around the anvil 226. As the shell contact member 204 is bending, the end portion 220 of the shell contact member 204 may engage the shelf 230 of the housing 28 to limit an amount that the shell contact member 204 is bent about the bend portion 222. As described above, in the exemplary embodiment at least a portion of the shell contact member 204 is optionally a spring. Specifically, in the exemplary embodiment the engagement between the shell 40 and the shell contact member 204 causes the shell contact member 204 to bend about the bend portion 222 against a natural bias of the shell contact member 204. The natural bias of the shell contact member 204 may thereafter facilitate maintaining the engagement between the shell 40 and the shell contact member 204, for example, to ensure an adequate electrical connection between the shell 40 and the ESD contact 200.

Although the shell contact member 204 is shown in FIGS. 6, 9, and 10 as being partially bent about the bend portion 222 before the shell 40 is installed on the housing 28, alternatively the shell contact member 204 is not initially bent about the bend portion 222 before the shell 40 is installed on the housing 28.

Figure 11:
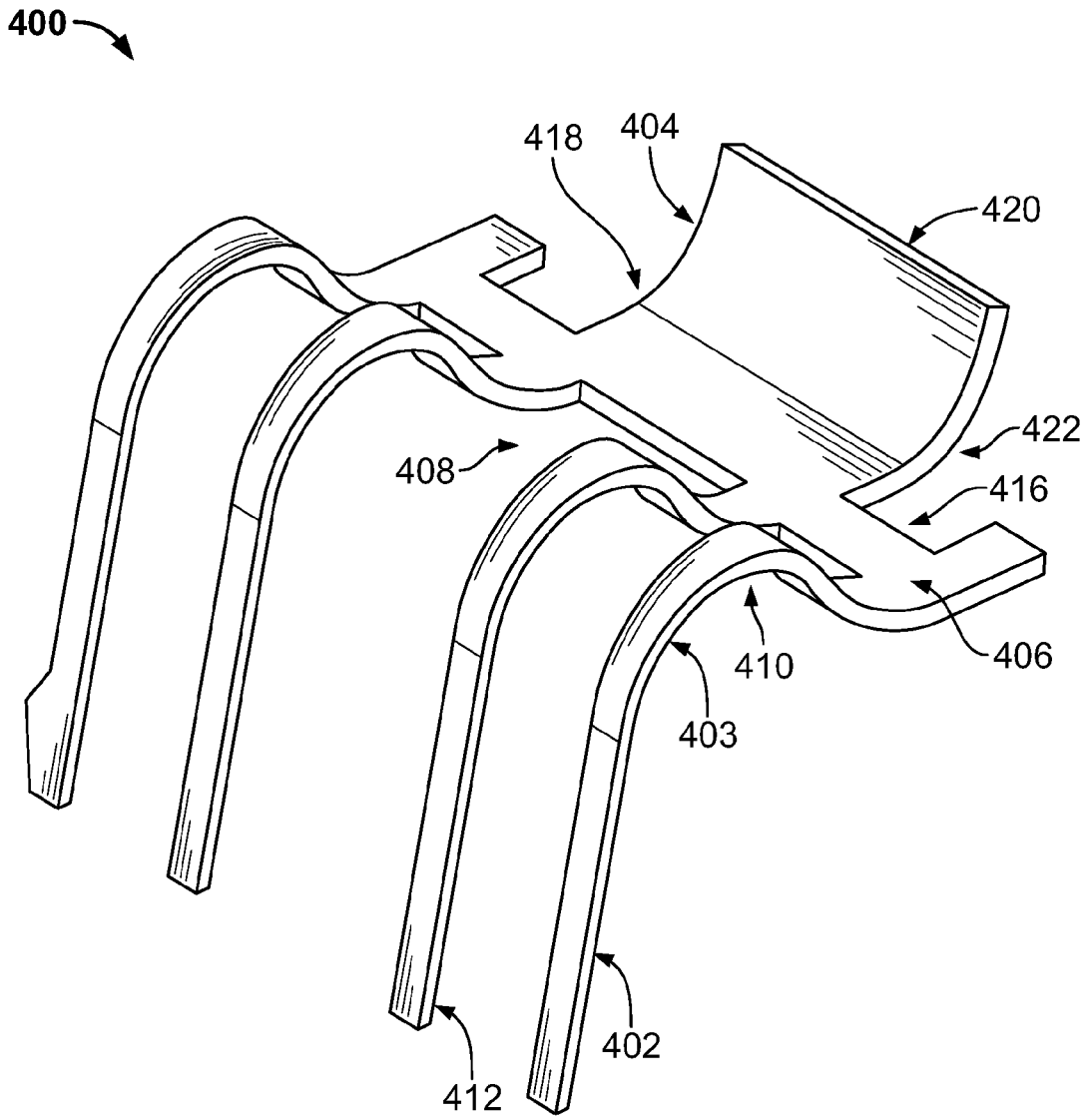
FIG. 11 is a perspective view of an exemplary alternative embodiment of an ESD contact for use with the electrical connector assembly shown in FIGS. 1-3, 5, and 8.

FIG. 11 is a perspective view of an exemplary alternative embodiment of an ESD contact 400 for use with the electrical connector assembly 14 (FIGS. 1-3, 5, and 8-10). The ESD contact 400 includes a base 406, a plurality of ground contact members 402, and a shell contact member 404. In the exemplary embodiment, each ground contact member 402 is an elongate leg that extends outwardly from a side portion 408 of the base 406. The base 406 is common to all of the ground contact members 402. Each ground contact member 402 extends outwardly from an end portion 410 that extends from the base 406 to a tip portion 412. In alternative to the elongate legs and/or any other structure of the ground contact members 402 described and/or illustrated herein, each ground contact member 402 may include any other suitable size, shape, structure, means, and/or the like that enable the ground contact members 402 to function as described and/or illustrated herein. Although four ground contact members 402 are shown herein, the ESD contact 400 may include any number of ground contact members 402 for engagement with any number of ground shields 132 (FIGS. 3 and 5).

Each of the ground contact members 402 includes a bend portion 403 and is a spring. Engagement between the ground contact members 402 and the corresponding ground shields 132 causes the ground contact members 402 to bend about the bend portions 403 against a natural bias of the ground contact members 402. The natural bias of the ground contact members 402 may thereafter facilitate maintaining the engagement between the ground contact members 402 and the corresponding ground shields 132, for example, to ensure an adequate electrical connection between the ground contact members 402 and the corresponding ground shields 132.

The shell contact member 404 extends outwardly from a side portion 416 of the base 406 that is opposite the side portion 408. In the exemplary embodiment, the shell contact member 404 is an elongate tab that extends outwardly from the base 406. The shell contact member 404 extends outwardly from an end portion 418 that extends from the base 406 to a free end portion 420. In the exemplary embodiment, the shell contact member 404 includes a bend portion 422 about which the shell contact member 404 is bent. In alternative to the elongate tab of the shell contact member 404, the bend portion 422, and/or any other structure of the shell contact member 404 described and/or illustrated herein, the shell contact member 404 may include any other suitable size, shape, structure, means, and/or the like that enable the shell contact member 404 to function as described and/or illustrated herein. Although only one shell contact member 404 is shown herein, the ESD contact 400 may include any number of shell contact members 404 for engagement with the shell 40 (FIGS. 1, 8, and 10). In the exemplary embodiment, at least a portion of the shell contact member 204 is optionally a spring.

Figure 12:
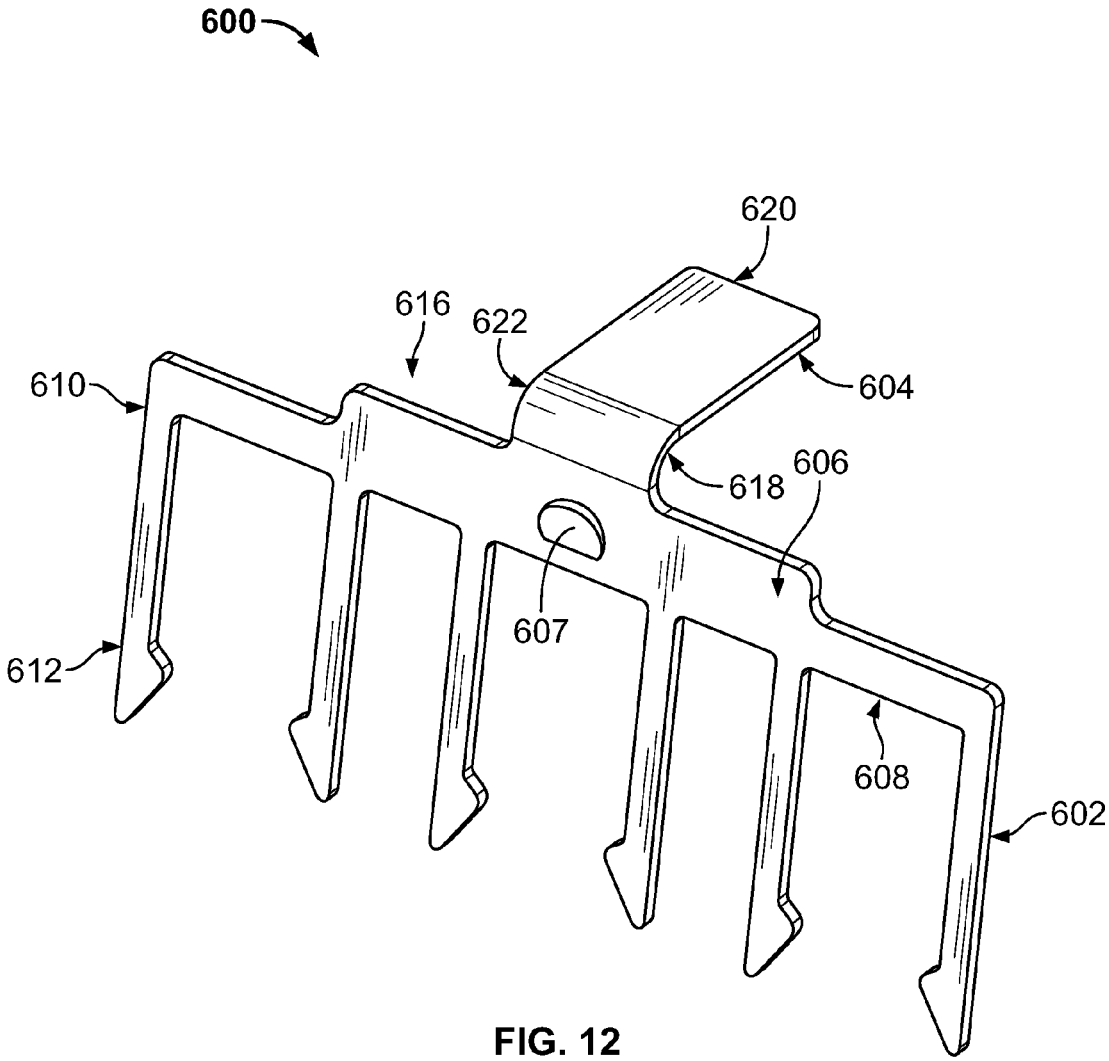
FIG. 12 is a perspective view of another exemplary alternative embodiment of an ESD contact for use with the electrical connector assembly shown in FIGS. 1-3, 5, and 8.

FIG. 12 is a perspective view of another exemplary alternative embodiment of an ESD contact 600 for use with the electrical connector assembly 14 (FIGS. 1-3, 5, and 8-10). The ESD contact 600 includes a base 606, a plurality of ground contact members 602, and a shell contact member 604. In the exemplary embodiment, each ground contact member 602 is an elongate leg that extends outwardly from a side portion 608 of the base 606. The base 606 is common to all of the ground contact members 602. Each ground contact member 602 extends outwardly from an end portion 610 that extends from the base 606 to a tip portion 612. In alternative to the elongate legs and/or any other structure of the ground contact members 602 described and/or illustrated herein, each ground contact member 602 may include any other suitable size, shape, structure, means, and/or the like that enable the ground contact members 602 to function as described and/or illustrated herein. Although four ground contact members 602 are shown herein, the ESD contact 600 may include any number of ground contact members 602 for engagement with any number of ground shields 132 (FIGS. 3 and 5).

The base 606 includes a dimple 607. Engagement between the dimple 607 and the housing 28 (FIGS. 1-3, 5, and 7-10) may bias the ESD contact 600 against the housing 28 to facilitate retaining the ESD contact 600 in position within the housing 28.

The shell contact member 604 extends outwardly from a side portion 616 of the base 606 that is opposite the side portion 608. In the exemplary embodiment, the shell contact member 604 is an elongate tab that extends outwardly from the base 606. The shell contact member 604 extends outwardly from an end portion 618 that extends from the base 606 to a free end portion 620. In the exemplary embodiment, the shell contact member 604 includes a bend portion 622 about which the shell contact member 604 is bent. In alternative to the elongate tab of the shell contact member 604, the bend portion 622, and/or any other structure of the shell contact member 604 described and/or illustrated herein, the shell contact member 604 may include any other suitable size, shape, structure, means, and/or the like that enable the shell contact member 604 to function as described and/or illustrated herein. Although only one shell contact member 604 is shown herein, the ESD contact 600 may include any number of shell contact members 604 for engagement with the shell 40 (FIGS. 1, 8, and 10). In the exemplary embodiment, at least a portion of the shell contact member 604 is optionally a spring.

The embodiments described and/or illustrated herein provide ESD protection to an electrical connector having multiple receptacles that each includes a center contact and a ground shield.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. An electrical connector assembly comprising:

a dielectric housing having an interface being configured to receive a mating end portion of a mating connector;

a plurality of receptacles held by the housing, each of the receptacles comprising a ground shield and a center contact, each center contact being configured to engage a corresponding electrical contact of the mating connector;

an electrically conductive shell surrounding at least a portion of the housing; and an electrostatic discharge (ESD) contact held by the housing, the ESD contact comprising a shell contact member and a plurality of ground contact members, the shell contact member being electrically connected to the shell, each ground contact member being electrically connected to a corresponding one of the ground shields of the receptacles.

2. The electrical connector assembly according to claim 1, wherein each of the ground contact members of the ESD contact comprises an elongate leg that extends outwardly from a common base of the ESD contact.

3. The electrical connector assembly according to claim 1, wherein the housing comprises at least one slot, at least one of the ground contact members of the ESD contact being received within the slot.

4. The electrical connector assembly according to claim 1, wherein the ground shield of at least one of the receptacles comprises at least two ground shield portions that at least partially surround the corresponding center contact, the corresponding ground contact member of the ESD contact comprising a pair of ground contact members that each engages a corresponding one of the ground shield portions.

5. The electrical connector assembly according to claim 4, wherein the ground shield portions are separate from each other.

6. The electrical connector assembly according to claim 1, wherein the shell contact member of the ESD contact comprises a spring.

7. The electrical connector assembly according to claim 1, wherein the shell contact member of the ESD contact comprises an elongate tab.

8. The electrical connector assembly according to claim 1, wherein the shell contact member of the ESD comprises a bend portion about which the shell contact member is bent, the shell contact member being bent about the bend portion during assembly of the electrical connector assembly via engagement with the shell as the shell is installed on the housing.

9. The electrical connector assembly according to claim 1, wherein the housing comprises an anvil, the shell contact member of the ESD contact comprising a bend portion engaged with the anvil such that the bend portion is bent around the anvil.

10. The electrical connector assembly according to claim 1, wherein the housing comprises a slot that exposes at least a portion of an interface between the shell contact member and the shell.

11. The electrical contact assembly according to claim 1, wherein at least one of the ground contact members of the ESD contact comprises a spring.

12. The electrical contact assembly according to claim 1, wherein at least one of the ground contact members of the ESD comprises a bend portion.

13. The electrical connector assembly according to claim 1, wherein the center contact of at least one of the receptacles comprises a receptacle contact.

14. The electrical connector assembly according to claim 1, wherein each receptacle comprises a dielectric body holding the corresponding center contact.

15. The electrical connector assembly according to claim 1, wherein each of the center contacts of the receptacles comprises one of a signal contact, a ground contact, and power contact.

16. An electrical connector assembly configured to be mounted to a panel, said electrical connector assembly comprising:

a dielectric housing having an interface being configured to receive a mating end portion of a mating connector;

a plurality of receptacles held by the housing, each of the receptacles comprising a ground shield and a center contact, each center contact being configured to engage a corresponding electrical contact of the mating connector;

an electrically conductive shell surrounding at least a portion of the housing, the electrically conductive shell configured to engage the panel; and an electrostatic discharge (ESD) contact held by the housing, the ESD contact comprising a shell contact member and a plurality of ground contact members, the shell contact member being electrically connected to the shell, each ground contact member being electrically connected to a corresponding one of the ground shields of the receptacles.

17. The electrical connector assembly according to claim 16, wherein each of the ground contact members of the ESD contact comprises an elongate leg that extends outwardly from a common base of the ESD contact.

18. The electrical connector assembly according to claim 16, wherein the ground shield of at least one of the receptacles comprises at least two ground shield portions that surround at least a portion of the corresponding center contact, the corresponding ground contact member of the ESD contact comprising a pair of ground contact members that each engages a corresponding one of the ground shield portions.

19. The electrical connector assembly according to claim 16, wherein the shell contact member of the ESD contact comprises a bend portion about which the shell contact portion is bent, the shell contact portion being bent about the bend portion during assembly of the electrical connector assembly via engagement with the shell as the shell is installed on the housing.

20. The electrical connector assembly according to claim 16, further comprising the panel, the wherein the shell is electrically connected to the panel.

* * * * *